US009820034B1

(12) United States Patent
Zhang et al.

(10) Patent No.: US 9,820,034 B1
(45) Date of Patent: Nov. 14, 2017

(54) SOUND DEVICE

(71) Applicants: Fuhu Zhang, Shenzhen (CN); Yue Zeng, Shenzhen (CN)

(72) Inventors: Fuhu Zhang, Shenzhen (CN); Yue Zeng, Shenzhen (CN)

(73) Assignee: AAC ACOUSTIC TECHNOLOGIES (SHENZHEN) CO., LTD, Shenzhen (CN)

( * ) Notice: Subject to any disclaimer, the term of this patent is extended or adjusted under 35 U.S.C. 154(b) by 0 days.

(21) Appl. No.: 15/416,998

(22) Filed: Jan. 26, 2017

(30) Foreign Application Priority Data

Oct. 26, 2016 (CN) ..... 2016 2 1176677 U

(51) Int. Cl.
*H04R 1/02* (2006.01)
*H04R 1/28* (2006.01)

(52) U.S. Cl.
CPC ..... *H04R 1/288* (2013.01); *H04R 1/025* (2013.01); *H04R 2499/11* (2013.01)

(58) Field of Classification Search
CPC . H04R 5/02; H04R 1/26; H04R 1/403; H04R 2499/11; H04R 1/028; H04R 2420/07; H04R 1/345; H04R 1/02; H04R 1/086; H04R 1/08; H04R 19/04; H04R 5/033; H04R 1/1016; H04R 1/1066; H04R 1/1008; H04R 1/1091; H04R 1/025; H04R 1/38
USPC ..... 381/71.5, 71.7, 152, 160, 162, 357, 382, 381/386, 304–305, 334–339, 345–354, 381/359–361, 372–374
See application file for complete search history.

(56) References Cited

U.S. PATENT DOCUMENTS

2013/0177169 A1* 7/2013 Kanaya ..... H04R 1/403 381/97
2014/0133684 A1* 5/2014 Zha ..... H04R 1/021 381/345
2015/0382090 A1* 12/2015 Bisset ..... H04R 1/2819 381/386

* cited by examiner

*Primary Examiner* — Rasha Al Aubaidi
(74) *Attorney, Agent, or Firm* — Na Xu; IPro, PLLC

(57) ABSTRACT

A sound device includes a housing with an accommodation space; a speaker unit located in the accommodation space and including a diaphragm for generating sound; a front cavity formed by the diaphragm and the housing; a sound channel communicated with the front cavity; and a sound-absorbing member made of sound-absorbing material located in the sound channel for covering a cross-section of the sound channel. The housing includes a bottom wall and a side wall extending from the bottom wall. The sound channel is configured to penetrate the side wall of the housing.

4 Claims, 2 Drawing Sheets

SOUND DEVICE

FIELD OF THE PRESENT DISCLOSURE

The present disclosure relates to the field of electro-acoustic transducers, and more particularly to a sound device used in a portable electronic device.

DESCRIPTION OF RELATED ART

With the increasingly thin consuming electronics products, such as mobile phones, tablet PCs and other portable electronic equipment, the sound cavity structure of the speaker is gradually changed from the front sound mode into the side sound mode.

The sound device of the related technology includes a housing with an accommodation space and a speaker unit located in the accommodation space. The speaker unit includes a diaphragm for generating sound via vibration. The diaphragm and the housing enclose a front cavity. The housing includes a bottom wall and a plurality of side walls extending from the bottom wall. Further, the sound device is provided with a sound channel arranged through the side wall and communicated with the front cavity.

However, the low-frequency sound-loss of the side sound structure is high, which affects the acoustic performance of the sound device.

Thereof, it is necessary to disclose and provide an improved sound device to overcome the above-mentioned disadvantages.

BRIEF DESCRIPTION OF THE DRAWING

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain this disclosure, not intended to limit this disclosure.

Figure 1:
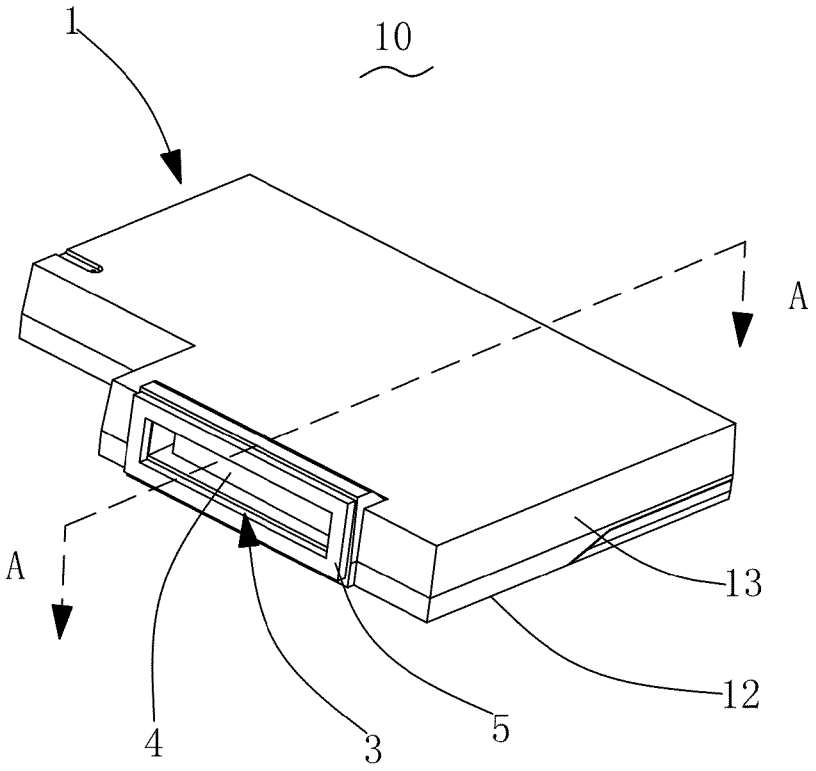
FIG. 1 is an isometric view of a sound device in accordance with an exemplary embodiment of the present disclosure.
Figure 2:
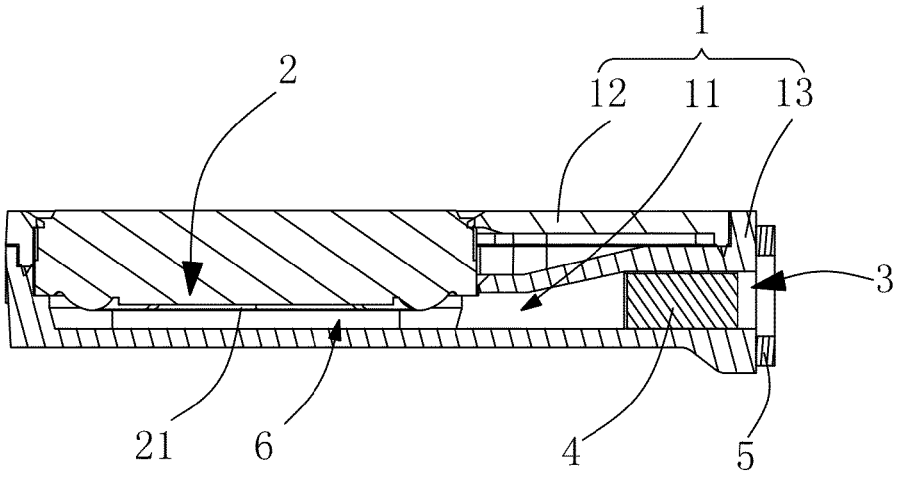
FIG. 2 is a cross-sectional view of the sound device taken along line A-A in FIG. 1.

Referring to FIGS. 1-2, the present disclosure provides a sound device 10 used in a portable electronic device, such as a mobile phone, a tablet, a computer. The sound device 10 includes a housing 1 with an accommodation space 11, a speaker unit 2 received in the accommodation space 11, a sound channel 3, a sound-absorbing member 4 and a cushion member 5.

The housing 1 comprises a bottom wall 12 and a side wall 13 extending from the bottom wall 12 for enclosing the accommodation space 11. The sound channel 3 is configured to penetrate the side wall 13.

The speaker unit 2 comprises a diaphragm 21 for generating sound. The housing 1 and the diaphragm 21 enclose a front cavity 6. The sound channel 3 is communicated with the front cavity 6.

The sound-absorbing member 4 is made of sound-absorbing material, and is located in the sound channel 3 for covering the cross-section of the sound channel 3.

Figure 3:
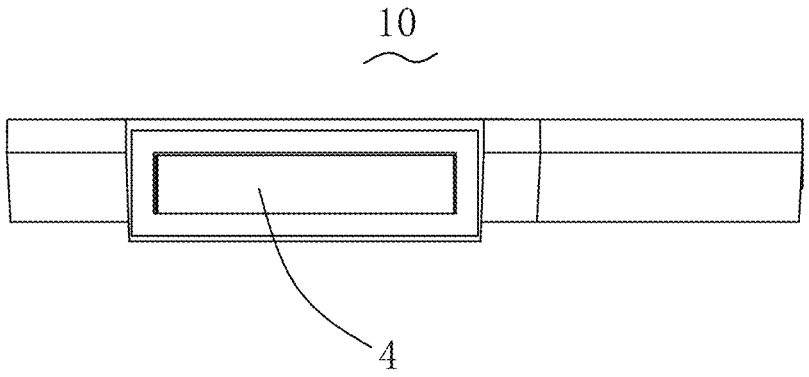
FIG. 3 is a side view of the sound device in FIG. 1.

Referring to FIG. 3, the sound channel 3 and the sound-absorbing member 4 are rectangular, and the size of the sound-absorbing member 4 is set so as to be matched with the size of the sound channel 3 and to cover the cross-section of the sound channel 3, which reduces the 400-600 hz peak of the sound device 10 and improves the manufacturing efficiency. Specifically, the sound-absorbing member 4 is affixed in the sound channel 3.

In the present example, the sound channel 3 has a width of 10.8 mm (millimeter) and a height of 1.8 mm, respectively. The length and the thickness of the sound-absorbing member 4 are 10.8 mm and 1.8 mm, respectively.

In the present example, it is necessary to indicate that the width of the sound channel 3 is the length of the sound-absorbing member 4, and the height of the sound channel 3 is the thickness of the sound-absorbing member 4.

Needless to say, the size of the sound channel 3 and the sound-absorbing member 4 is not limited, which may be other dimensions, and it is OK as long as the size of the sound-absorbing member 4 is matched with the size of the sound channel 3, which may be filled on the cross-section of the sound channel 3. The principle is the same.

Optionally, the sound-absorbing member 4 has a width of 3 mm. Hereby, the width of the sound-absorbing member 4 refers to the length in the direction of the sound channel 3. In the present example, the sound-absorbing member 4 is a rectangular parallelepiped structure with the dimensions of 10.8 mm, 1.8 mm, and 3 mm, and the sound channel 3 is a channel with a rectangular cross-section.

It is necessary to indicate, in the sound device 10 of the present disclosure, the shape and size of the sound channel 3 and the sound-absorbing member 4 are not limited, the sound-absorbing member 4 is required to be provided in the sound channel 3 only, and the sound-absorbing member 4 may be filled on the cross-section of the sound channel 3 fully.

In order to prevent the end surface of the sound channel 3 from abutting against the other parts when the sound device 10 is mounted in the other electronic products, and the sound absorbing cotton 4 is removed or dropped off, in the present example, the sound-absorbing member 4 is arranged at a distance from the end surface of the sound channel 3 to form a protective structure.

The cushion member 5 is provided around the sound channel 3 and is attached to one end of the sound channel 3 away from the diaphragm 21. The structure is also arranged to prevent the sound channel 3 from being directly struck to drop the sound-absorbing member 4 when the sound device 10 is assembled into another product, provide a cushioning effect and enhance the performance of stability of the sound device 10.

Compared with the related technology, the sound device of the present disclosure is to fill the sound-absorbing member in the sound channel to absorb the sound, the sound-absorbing member covers the cross-section of the sound channel. Thereby reduce the peak of 400-600 hz, and reduce the low-frequency distortion of the sound device so that the sound device has a high acoustic performance.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound device, comprising:

a housing with an accommodation space, the housing including a bottom wall and a side wall extending from the bottom wall;

a speaker unit located in the accommodation space, including a diaphragm for generating sound, wherein the diaphragm divides the accommodation space into a front cavity in front of the diaphragm and a back cavity behind the diaphragm;

a sound channel arranged through the side wall for communicating the front cavity and outside of the sound device, wherein the sound channel transmits the sound from the front cavity to outside of the sound device;

a sound-absorbing member made of sound-absorbing material located in the sound channel for blocking the sound channel, wherein the sound passes through the sound-absorbing member to outside of the sound device, a cushion member arranged around the sound channel and affixed to one end of the sound channel away from the diaphragm, wherein the sound-absorbing member is arranged at a distance from an end surface of the sound channel to form a protective structure and covers a cross-section of the sound channel for reducing peak of 400-600 hz and low-frequency distortion of the sound device.

2. The sound device as described in claim 1, wherein the sound-absorbing member is rectangular in cross-section, and the sound-absorbing member is attached to the sound channel.

3. The sound device as described in claim 2, wherein the sound channel has a width of 10.8 mm and a height of 1.8 mm respectively; a length and a thickness of the sound-absorbing member are 10.8 mm and 1.8 mm respectively.

4. The sound device as described in claim 3, wherein a width of the sound-absorbing member is 3 mm.

* * * * *